US010266926B2

(12) United States Patent
Feng et al.

(10) Patent No.: US 10,266,926 B2
(45) Date of Patent: Apr. 23, 2019

(54) CAST NICKEL-BASE ALLOYS INCLUDING IRON

(71) Applicant: GENERAL ELECTRIC COMPANY, Schenectady, NY (US)

(72) Inventors: Ganjiang Feng, Greenville, SC (US); Jon Conrad Schaeffer, Simpsonville, SC (US); Michael Douglas Arnett, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 924 days.

(21) Appl. No.: 13/868,481

(22) Filed: Apr. 23, 2013

(65) Prior Publication Data

US 2014/0314618 A1 Oct. 23, 2014

(51) Int. Cl.
*C22C 19/05* (2006.01)
*C22C 30/00* (2006.01)

(52) U.S. Cl.
CPC ..... *C22C 30/00* (2013.01); *C22C 19/055* (2013.01); *C22C 19/056* (2013.01); *C22C 19/057* (2013.01)

(58) Field of Classification Search
CPC ... C22C 19/055; C22C 19/056; C22C 19/057; C22C 30/00; C22F 1/10
See application file for complete search history.

(56) References Cited

U.S. PATENT DOCUMENTS

| | | | | |
|---|---|---|---|---|
| 3,748,110 A * | 7/1973 | Hodshire et al. | ..... | 428/652 |
| 4,039,330 A | 8/1977 | Shaw | | |
| 5,338,379 A | 8/1994 | Kelly | | |
| 5,413,647 A | 5/1995 | Ablett et al. | | |
| 5,863,494 A | 1/1999 | Nazmy et al. | | |
| 7,011,721 B2 | 3/2006 | Harris et al. | | |
| 7,341,427 B2 | 3/2008 | Farmer et al. | | |
| 2006/0157171 A1 | 7/2006 | Ueta et al. | | |
| 2012/0183432 A1 | 7/2012 | Devaux et al. | | |

FOREIGN PATENT DOCUMENTS

| | | | | |
|---|---|---|---|---|
| EP | 0 849 370 * | 6/1998 | ..... | C22C 19/05 |
| EP | 2128283 A2 | 12/2009 | | |
| EP | 2292807 A1 | 3/2011 | | |
| GB | 2 148 323 * | 5/1985 | ..... | C22C 19/056 |
| JP | 48004331 A | 1/1973 | | |
| JP | 51034819 A | 3/1976 | | |
| JP | 06017171 A | 1/1994 | | |
| JP | 06220607 A | 8/1994 | | |
| JP | 2004197216 A | 7/2004 | | |
| JP | 2011033023 A | 2/2011 | | |
| JP | 2011052323 A | 3/2011 | | |
| JP | 2013502511 A | 1/2013 | | |
| JP | 2013049902 A | 3/2013 | | |

OTHER PUBLICATIONS

European Search Report and Written Opinion issued in connection with corresponding EP Application No. 14165495.4-1362 dated Jul. 24, 2014.

Ojo, "Intergranular Liquidation Cracking in Heat Affected Zone of a Welded Nickel Based Superalloy in as Cast Condition", Materials Science Technology, vol. 23, Issue No. 10, pp. 1149-1155, published online Jul. 19, 2013.

European Office Action issued in connection with corresponding EP Application No. 14165495.4, dated Sep. 10, 2015.

English Translation of Chinese Office Action issued in connection with corresponding CN Application No. 201410165340.X dated Nov. 4, 2016.

Office Action from the Japan Patent Office, Notice of Preliminary Rejection, Japanese Application No. 2014-084098, dated Mar. 6, 2018.

* cited by examiner

*Primary Examiner* — Jessee R Roe
(74) *Attorney, Agent, or Firm* — McNees Wallace & Nurick LLC

(57) ABSTRACT

A cast nickel-base superalloy that includes iron added substitutionally for nickel. The cast nickel base superalloy comprises, in weight percent about 1-6% iron, about 7.5-19.1% cobalt, about 7-22.5% chromium, about 1.2-6.2% aluminum, optionally up to about 5% titanium, optionally up to about 6.5% tantalum, optionally up to about 1% Nb, about 2-6% W, optionally up to about 3% Re, optionally up to about 4% Mo, about 0.05-0.18% C, optionally up to about 0.15% Hf, about 0.004-0.015 B, optionally up to about 0.1% Zr, and the balance Ni and incidental impurities. The superalloy is characterized by a γ' solvus temperature that is within 5% of the γ' solvus temperature of the superalloy that does not include 1-6% Fe and a mole fraction of γ' that is within 15% of the mole fraction of the superalloy that does not include 1-6% Fe.

5 Claims, 7 Drawing Sheets

CAST NICKEL-BASE ALLOYS INCLUDING IRON

FIELD OF THE INVENTION

The present invention relates to a cost-effective nickel base superalloy that includes a small amount of iron, and more specifically, to a cast nickel based superalloy including a low weight percentage of iron substituted for nickel for use in turbine airfoil applications.

BACKGROUND OF THE INVENTION

Components located in the high temperature section of gas turbine engines are typically formed of superalloys, which includes nickel-base superalloys, iron-base superalloys, cobalt-base superalloys and combinations thereof. High temperature sections of the gas turbine engine include the combustor section and the turbine section. In some types of turbine engines, the high temperature section may include the exhaust section. The different hot sections of the engine may experience different conditions requiring the materials comprising the components in the different sections to have different properties. In fact, different components in the same sections may experience different conditions requiring different materials in the different sections.

Turbine buckets or airfoils in the turbine section of the engine are attached to turbine wheels and rotate at very high speeds in the hot exhaust gases of combustion expelled by the turbine section of the engine. These buckets or airfoils must simultaneously be oxidation-resistant and corrosion-resistant, maintaining their microstructure at elevated temperatures of use while maintaining mechanical properties such as creep resistance/stress rupture, strength and ductility. Because these turbine buckets have complex shapes, in order to reduce costs, they should be castable to reduce processing time to work the material as well as machining time to achieve the complex shapes.

Nickel-base superalloys have typically been used to produce components for use in the hot sections of the engine since they can provide the desired properties that satisfy the demanding conditions of the turbine section environment. These nickel-base superalloys have high temperature capabilities, while achieving strength from precipitation strengthening mechanisms which include the development of gamma prime precipitates. The nickel-base superalloys in their cast form are utilized for buckets and currently are made from nickel-base superalloys such as René N4, René N5, which form high volume fractions of gamma prime precipitates when heat treated appropriately, and GTD®-111, Rene 80 and In 738, which form somewhat lower volume fractions of gamma prime precipitates when heat treated appropriately. GTD® is a trademark of General Electric Company, Fairfield, Conn. Other nickel base superalloys forming even lower volume fractions of gamma prime, such as GTD® 222 and IN 939 are used in lower temperature applications, such as nozzle or exhaust applications.

High weight percentages of nickel add to the cost of nickel-base superalloys because nickel is an expensive material. In addition, nickel is a strategic alloy, being used in many critical industries around the globe. Even though it is a strategic resource, primary sources of nickel are Australia, Canada, New Caledonia and Russia. Currently, there is only one working nickel mine in the United States. So, finding an effective low-cost substitute for nickel is beneficial both from a cost perspective and from a strategic perspective.

What is needed is a low cost substitute for nickel in superalloys, such as nickel-base superalloys. More specifically. for turbine applications, what is needed is a readily available low cost substitute for nickel-base superalloys that can be used without affecting the high temperature mechanical properties of the alloy included such properties as creep/stress rupture, tensile properties as well oxidation resistance, corrosion resistance and castability.

SUMMARY OF THE INVENTION

A cast nickel-base superalloy is provided. In its broadest embodiment, the cast nickel base superalloy comprises, in weight percent about 1-6% iron (Fe), about 7.5-19.1% cobalt (Co), about 7-22.5% chromium (Cr), about 1.2-6.2% aluminum (Al), optionally up to about 5% titanium (Ti), optionally up to about 6.5% tantalum (Ta), optionally up to about 1% Nb, about 2-6% tungsten (W), optionally up to about 3% rhenium (Re), optionally up to about 4% molybdenum (Mo), about 0.05-0.18% carbon (C), optionally up to about 0.15% hafnium (Hf), about 0.004-0.015 boron (B), optionally up to about 0.1% zirconium (Zr), and the balance nickel (Ni) and incidental impurities.

This cast nickel-base superalloy is characterized by the substitution of Fe for Ni in the matrix on a one-for-one atomic basis. However, the iron is added in an amount so as not to negatively impact the important mechanical properties of the cast nickel-base superalloy, the microstructure of the nickel-base superalloy, its oxidation resistance or its corrosion resistance. The substitution of iron for nickel decreases the overall cost of the cast product.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
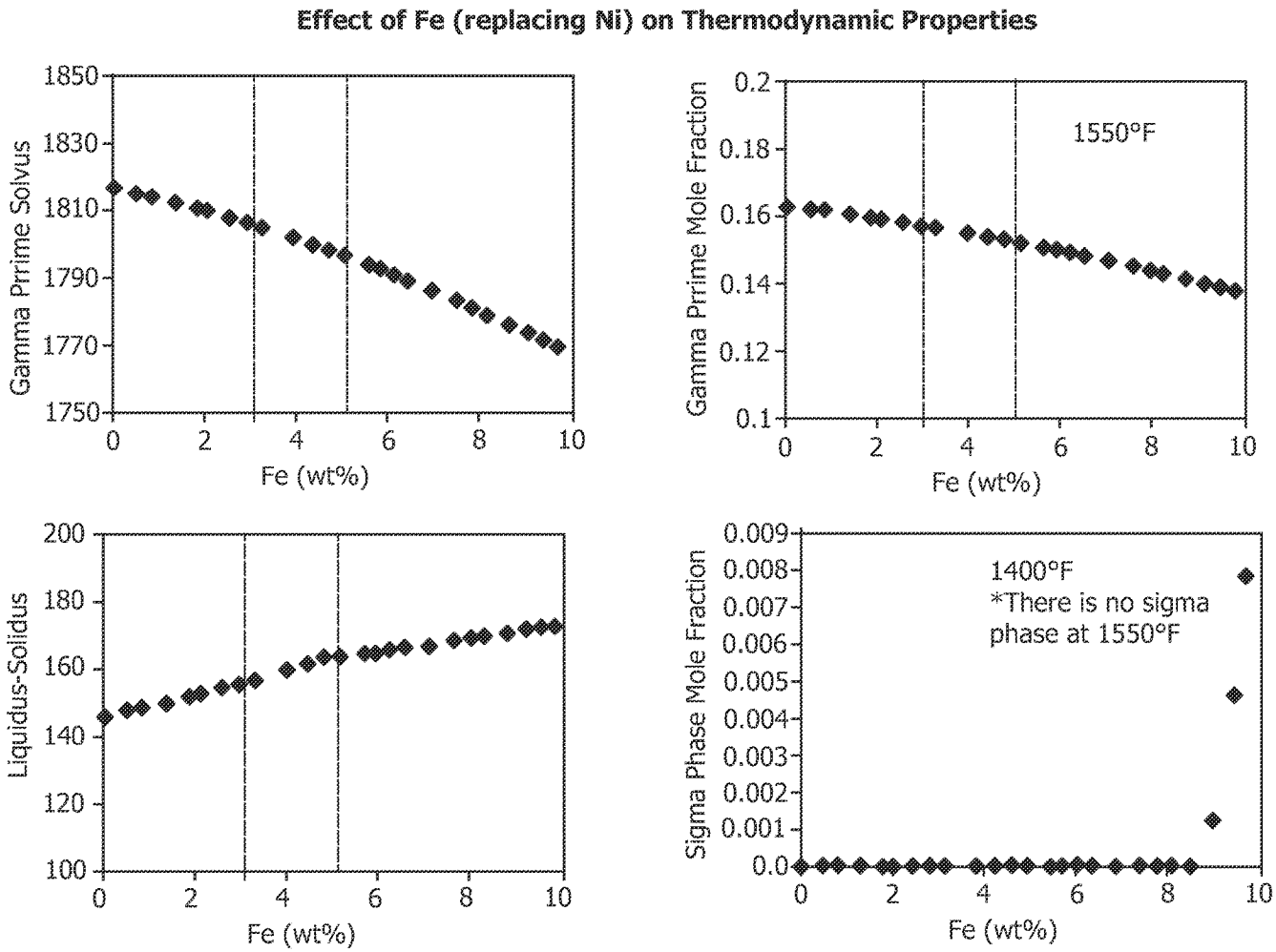
FIG. 1 depicts the effect of increased Fe in nickel-base superalloy GTD® 222 on the following properties: gamma prime solvus, gamma prime mole fraction at 1550° F., liquidus-solidus differential (or freezing range) and sigma phase formation at 1400° F.
Figure 2:
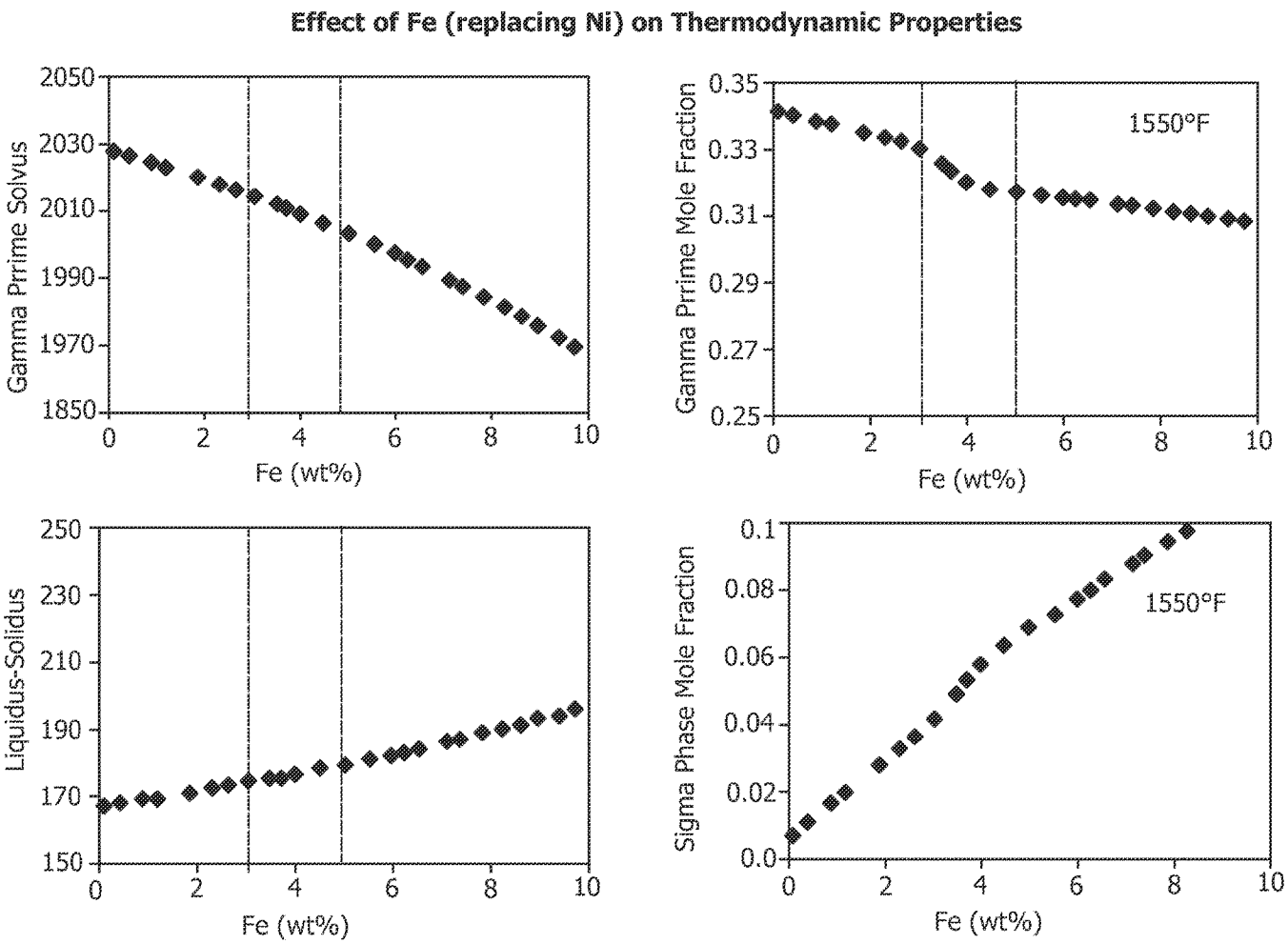
FIG. 2 depicts the effect of increased Fe in nickel-base superalloy IN 939 on the following properties: gamma prime solvus, gamma prime mole fraction at 1550° F., liquidus-solidus differential (or freezing range) and sigma phase formation at 1550° F.
Figure 3:
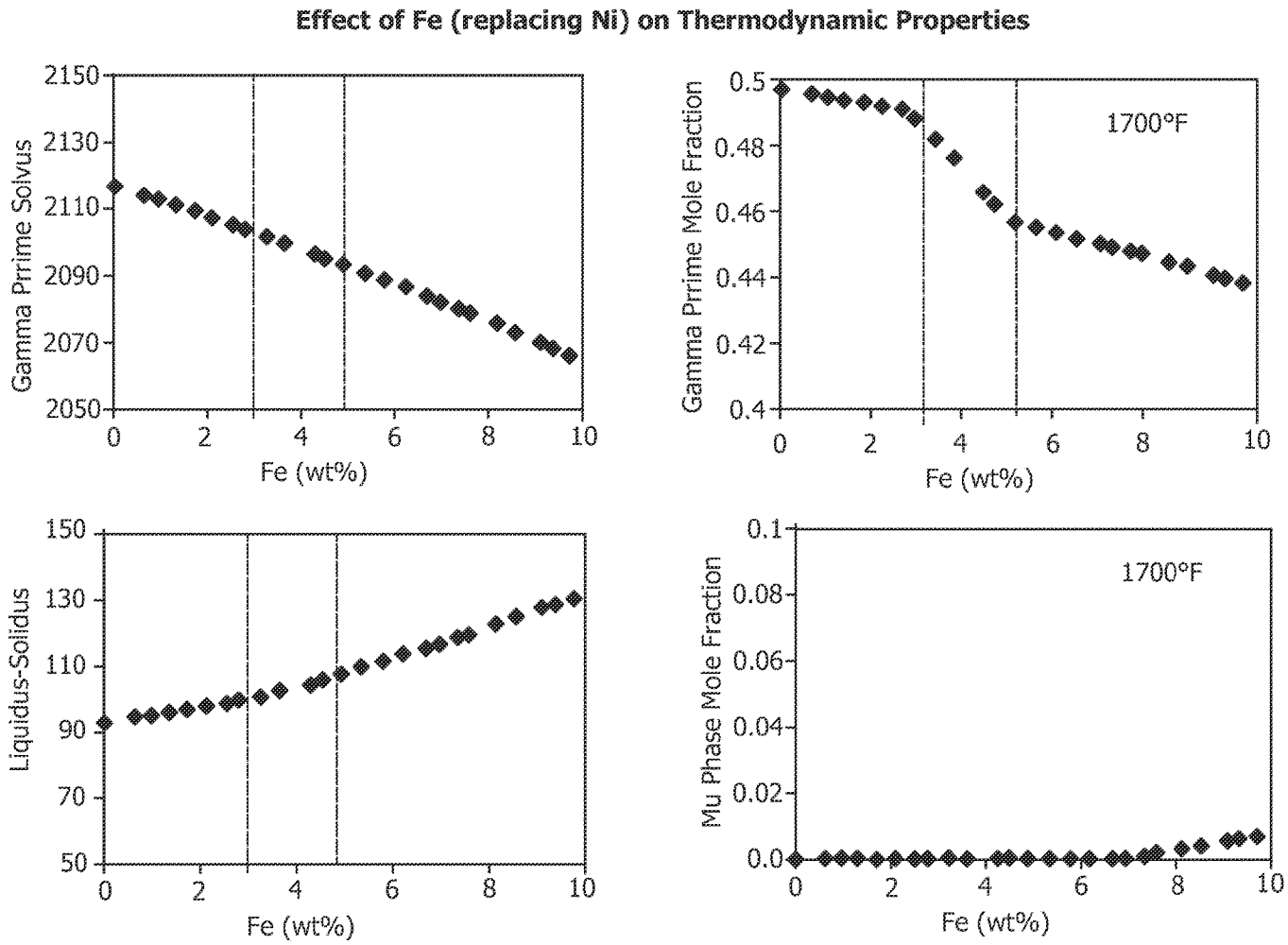
FIG. 3 depicts the effect of increased Fe in nickel-base superalloy GTD® 111 on the following properties: gamma prime solvus, gamma prime mole fraction at 1700° F., liquidus-solidus differential (or freezing range) and Mu phase formation at 1700° F.
Figure 4:
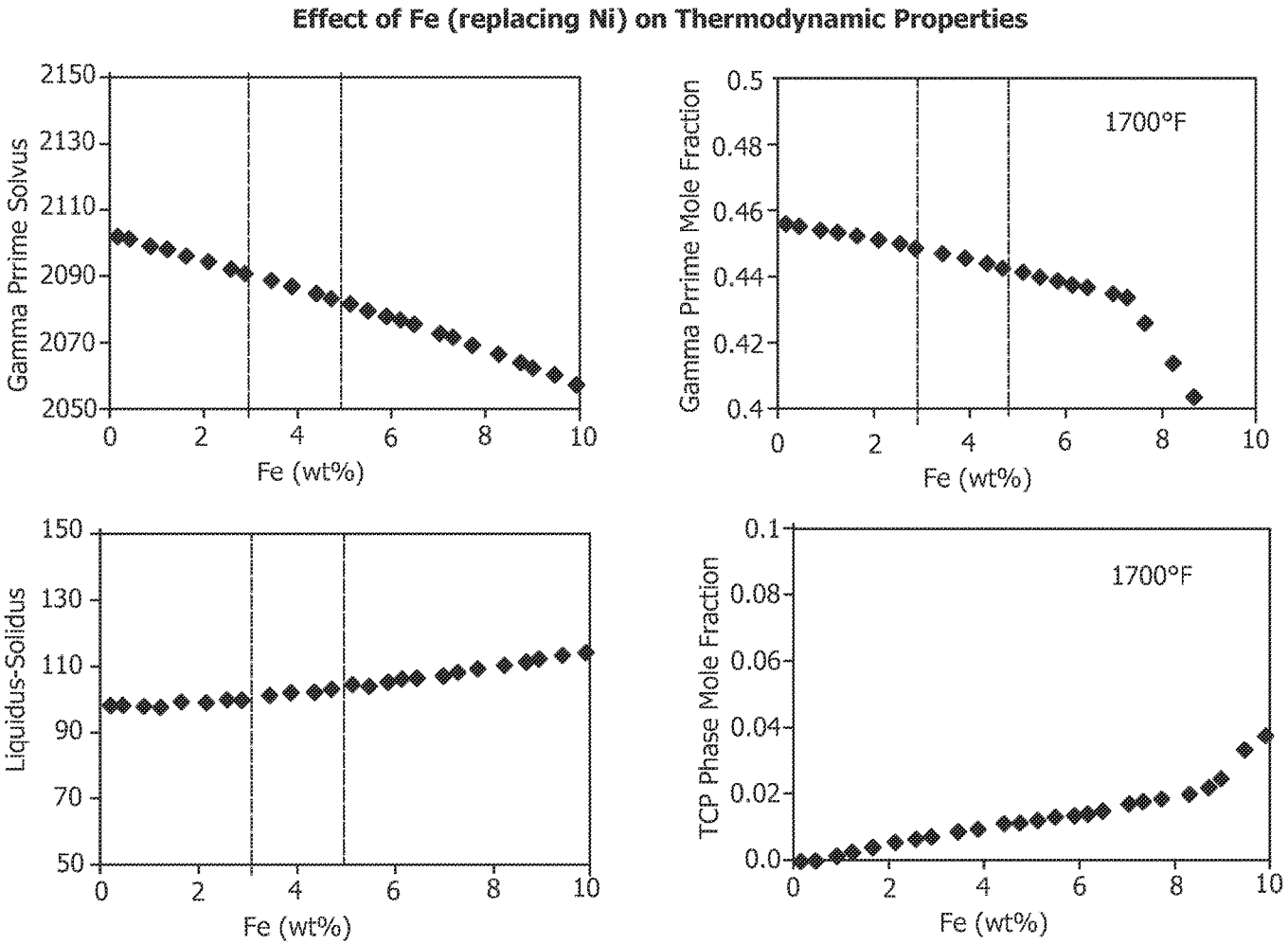
FIG. 4 depicts the effect of increased Fe in nickel-base superalloy RENE 80 on the following properties: gamma prime solvus, gamma prime mole fraction at 1700° F., liquidus-solidus differential (or freezing range) and TCP phase formation at 1700° F.
Figure 5:
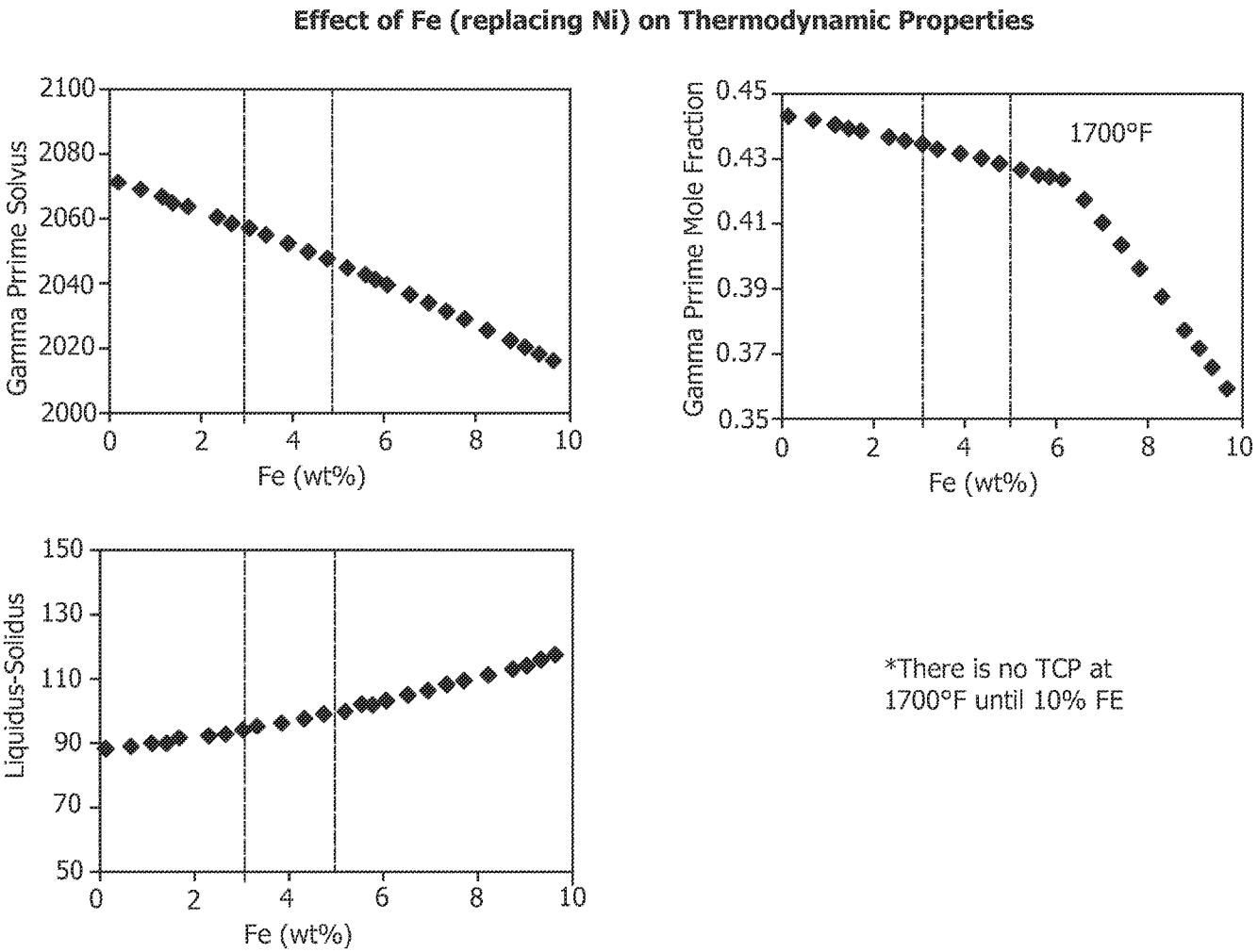
FIG. 5 depicts the effect of increased Fe in nickel-base superalloy IN 738 on the following properties: gamma prime solvus, gamma prime mole fraction at 1700° F., liquidus-solidus differential (or freezing range) and TCP phase formation at 1700° F.

In a broad embodiment of the present invention, the cast nickel base superalloy comprises, in weight percent, 1-5% iron (Fe), 7.5-19.1% cobalt (Co), 7-22.5% chromium (Cr), 1.2-6.2% aluminum (Al), up to 5% titanium (Ti), up to 6.5% tantalum (Ta), up to 1% Nb, 2-6% tungsten (W), up to 3% rhenium (Re), up to 4% molybdenum (Mo), 0.05-0.18% carbon (C), up to 0.15% hafnium (Hf), 0.004-0.015 boron (B), up to 0.1% zirconium (Zr), and the balance nickel (Ni) and incidental impurities. However, since Fe is added at the atomic level within the nickel matrix substitutionally to reduce the amount of the strategic element Ni, more than trace amounts of Fe must be added to the alloy in order to reduce the overall cost of the alloy, but not so much Fe should be added to negatively impact the mechanical properties, the corrosion resistance, the oxidation resistance, the castability or the microstructure of the alloy. A preferred amount of Fe is 1-4.5% by weight. Other preferred amounts 1.5-3.5% by weight Fe, and 3-5% by weight Fe. The most preferred amount is within the range of 2-3%.

The nickel-base superalloy including Fe as a Ni substitute should have a gamma prime (γ') solvus temperature that is no more that 5% less than that of the prior art composition of the alloy without Fe. The alloy also should have a γ' mole fraction that is no more that 15% less than that of the prior art composition without Fe, and preferably no more that 10% less than that of the prior art composition without Fe. These properties may impact the operating temperature, the strength at temperature, and the creep/rupture resistance at temperature.

The amounts of the various elements included in the alloys set forth herein are expressed in weight percentages, unless otherwise specified. The term "balance essentially Ni" or "balance of the alloy essentially Ni" is used to include, in addition to Ni, small amounts of impurities and other incidental elements, some of which have been described above, that are inherent in cast nickel-base superalloys, which in character and/or amount do not affect the advantageous aspects of the nickel-base superalloy. The amount of precipitates in a precipitation hardenable nickel-base superalloy discussed herein, including beneficial precipitates such as γ' phase and detrimental precipitates such as Mu, sigma and TCP phases are expressed in mole fractions, unless otherwise specified. As used herein, the nominal composition of an alloy includes the recognized range of compositions of the individual elements comprising the alloy identified in available, well known specifications of the alloy such as AMS, SAE, MIL-Standards, incorporated herein by reference, even though the individual element may be identified as a single representative value usually associated with the mid-point of the compositional range.

Provided below in Table 1 are the nominal compositions of several different types of prior art cast nickel-base superalloys. While these cast nickel-base superalloys have differing compositions, most do not include any Fe. Only In 738 includes Fe, and it is maintained at a nominal level of about 0.5%. Cast nickel-base superalloys have generally been viewed as iron-free, and provided in compositions that are substantially free of iron. Without wishing to be bound by theory, it is believed that Fe has not been included in greater concentrations as iron has been thought to negatively impact the mechanical properties and oxidation resistance of the nickel-base superalloys.

TABLE 1

| Alloy | Ni | Co | Fe | Cr | Al | Ti | Ta | Nb | W | Re | Mo | C | Hf | B | Zr |
|---|---|---|---|---|---|---|---|---|---|---|---|---|---|---|---|
| GTD ®222 | bal. | 19.1 | | 22.5 | 1.2 | 2.3 | 0.94 | 0.8 | 2 | | | 0.08 | | 0.004 | 0.02 |
| IN 939 | bal. | 19 | | 22.5 | 1.9 | 3.7 | 1.4 | 1 | 2 | | | 0.15 | | 0.01 | 0.1 |
| GTD ®111 | bal. | 9.5 | | 14 | 3 | 4.9 | 2.8 | | 3.8 | | 1.5 | 0.1 | | 0.01 | |
| René 80 | bal. | 9.5 | | 14 | 3 | 5 | | | 4 | | 4 | 0.17 | | 0.015 | 0.03 |
| IN 738 | bal. | 8.5 | 0.5 | 16 | 3.45 | 3.45 | 1.75 | 0.85 | 2.6 | | 1.75 | 0.18 | | 0.01 | 0.01 |
| René N4 | bal. | 7.5 | | 9.75 | 4.2 | 3.5 | 4.8 | 0.5 | 6 | | 1.5 | 0.05 | 0.15 | 0.004 | |
| René N5 | bal. | 7.5 | | 7 | 6.2 | | 6.5 | | 5 | 3 | 1.5 | 0.05 | 0.15 | 0.004 | |

While the alloys listed above are all cast nickel-base superalloys, there are variations in composition based on properties, which can dictate usage of the cast product. Thus, for example, GTD®-222 and IN-739 are used for nozzle castings. As used herein, these materials are termed low γ' alloys. γ' is a strengthening precipitate that forms when Ni combines with Al and Ti when heat treated properly. Ta, W, Nb and V may be substituted for Ti or Al in forming γ', although none of the alloys in Table 1 include vanadium.

Nickel-base superalloys that include GTD®-111, René 80 and IN 738 are termed medium γ' alloys, contain a higher volume fraction of γ' than low γ' alloys and are suitable for higher temperature, higher strength and higher creep/stress rupture resistance applications than low γ' alloys.

Nickel-base superalloy such as Rene N4 and Rene N5 that include a high volume fraction of γ' than either low or medium γ' alloys, and are suitable for use in the hottest sections of the gas turbine and can withstand the highest stress conditions.

The low γ' alloys generally are characterized by low weight percentages of Al and Ti (as compared to medium and high γ' alloys), which combine with Ni to form γ', $Ni_3(Al,Ti)$. γ' is a precipitate that is formed in the cast nickel-base superalloys that strengthens these alloys, when heat treated properly. The nozzle castings comprised of GTD®-222 and IN-739 are stationary parts not subject to high stresses, creep or stress-rupture, so these low gamma prime alloys have sufficient strength for such uses.

GTD®-111, René 80, IN-738, René N4 and Rene N5 may be used for turbine blades or turbine buckets and in the combustor section of the gas turbine. (René was the registered trademark, now cancelled, of Allvac Metals Corporation of Monroe, N.C.) These nickel-base materials are medium and high γ' alloys, and are characterized by higher weight percentages of Al and Ti than both GTD®-222 and IN-939. Al and Ti combine with Ni to form γ', $Ni_3(Al,Ti)$, which is a precipitate that is formed in the cast nickel-base superalloys that strengthens these alloys, when heat treated properly. The turbine buckets or blades rotate at high speeds and are subject to high stresses and high temperatures. Because these buckets or blades are in the flow path of hot gases of combustion, they are also subject to creep and stress-rupture as a result of high rotational speed. In the combustor and early stage turbine sections, (stage 1 and stage 2) temperatures are highest, and gas temperatures may be in excess of 2000° F., although various active cooling schemes and thermal barrier coatings maintain the temperature of the alloy materials at lower temperatures, in the range of 1700-1900° F. In later turbine stages, the gas temperatures decrease and again active cooling schemes and thermal barrier coatings maintain the alloy materials forming the buckets at temperatures lower than the gas temperatures, in the range of 1600-1800° F. Further downstream, for example in the turbine exhaust, gas temperatures are even lower.

Because higher elevated temperature strength as well as resistance to stress rupture is required, low γ' materials are not suitable for combustor or turbine applications, although they may find use further downstream in the exhaust section of the turbine, also referred to as the nozzle section. Medium and high γ' strengthened materials provide the additional strength needed for use in the combustor and turbine sections of the turbine engine. Additional Al and/or Ti must be included in the composition of these alloys in order to develop the γ' that strengthens these alloys, and the nominal compositions of these alloys listed in Table I reflects these increased weight percentages of Al and/or Ti and/or Ta and or W in medium and high γ' alloys.

Al and Ti increase the volume fraction of γ' in the superalloy. The strength of the superalloy increase with increasing Al+Ti. Strength also increases with increasing ratio of Al to Ti. Increasing volume fraction of γ' also increases the creep resistance of the superalloy.

Co is added and is believed to improve the stress and creep-rupture properties of the cast nickel-base superalloy.

Cr increases the oxidation and hot corrosion resistance of the superalloy. Cr is also believed to contribute to solid solution strengthening of the superalloy at high temperature and improved creep-rupture properties in the presence of C.

C contributes to improved creep-rupture properties of cast Ni-base superalloys. The C interacts with Cr, and possibly other elements to form grain boundary carbides.

Ta, W, Mo and Re are higher melting refractory elements that improve creep-rupture resistance. These elements may contribute to solid solution strengthening of the γ matrix that persists to high temperature. Mo and W reduce diffusivity of hardening elements such as Ti, thereby extending the amount of time required for coarsening of γ', improving high temperature properties such as creep-rupture. Ta and W also may substitute for Ti in the formation of γ' in certain alloys.

Nb may be included to promote the formation of γ' and may substitute for Ti in the formation of γ' in certain alloys as previously noted.

Hf, B and Zr are added in low weight percentages to cast nickel-based superalloys to provide grain boundary strengthening. Boride formation may form in grain boundaries to enhance grain boundary ductility. Zirconium also is believed to segregate to grain boundaries and may help tie up any residual impurities while contributing to ductility. Hafnium contributes to the formation of γ-γ' eutectic in the cast superalloys, as well as to promotion of grain boundary γ' which contributes to ductility.

While cast nickel-base superalloys do not utilize Fe in appreciable quantities (IN 738 utilizing 0.5%), the present invention substitutes Fe for Ni on a one-for-one atomic level in the range of from 1%-6% Fe by weight, and preferably 1%-5% Fe by weight. Fe substitutes for Ni in the Ni matrix. Fe has not been used in cast nickel-base superalloys because of concerns that Fe may negatively impact certain mechanical properties of the cast Ni-base superalloys. Because of the high nickel and Cr content of these nickel-base superalloys, Ni+Cr being greater than 65%, and preferably greater than 70%, the substitution of Fe for Ni on a one-for-atomic level up to 5% should not affect the oxidation resistance of the alloy. Fe added at the atomic level within the nickel matrix will substitute for Ni atoms in the face centered cubic (fcc) matrix and will reduce the amount of the strategic element Ni used in the alloy. This will not only reduce the dependence of turbine components on the critical element Ni, but will also serve to reduce material costs of such components when more than trace amounts of Fe are added to the nickel-base alloys.

The amount of Fe that may be added to nickel-base superalloys on a substitutional basis must not negatively impact the mechanical properties for their applications. Oxidation resistance was discussed in the preceding paragraph. Creep strength at a particular temperature of usage generally is related to the amount of γ' at the temperature of usage, and the temperature of usage also is affected by the γ' solvus temperature. The γ' solvus temperature is the temperature at which γ' begins to solutionize or dissolve in the matrix. The amount of γ' also is related directly to the strength of the nickel-base superalloy. Castability of the alloy also should not be affected, and castability is related to the liquidus-solidus temperature differential. While the melting temperature is desirably comfortably above the temperature that the component will experience during usage, the freezing range is the difference between the liquidus and solidus temperatures of the alloy, that is the temperature range over which the conversion of molten liquid to solid occurs in an alloy. A large freezing range can adversely affect the castability of an alloy. Although the freezing mechanism is a complex process, freezing occurring over a large range of high temperatures can occur over a longer period of time leading to segregation in the alloy that can result in casting defects, particularly in complex castings, when metal feed can be compromised. In some cases, problems associated with such defects can be corrected but may require redesign of molds, such as investment cast molds. Even when casting defects can be removed, homogenization may be required, which necessitates additional time at elevated temperatures, thereby increasing costs. Generally, a smaller freezing range is preferred, which minimizes segregation and allows for designs in which thin sections can be allowed to freeze first and be fed from larger sections.

The cast Ni-base superalloys of the present invention that includes Fe include a high volume fraction of γ', like its Fe-free counterpart, although the volume fraction will vary depending on alloy composition, as discussed above. The cast superalloy of the present invention acquires its strength from a substantially uniformly distributed fine γ'. After casting, in order to develop the suitable mechanical properties, the cast alloy must be heat treated. The preferred heat treatment cycle requires solutioning the alloy above its γ' solvus usually for about 4 hours to dissolve any γ' formed during the solidification process. This is followed by air cooling and then aging at a temperature below the γ' to develop fine, uniformly distributed precipitates, usually for one hour at temperature. If desired, the precipitates which are developed may be further aged or coarsened in the temperature range of 1350-1600° F. for a suitable time to provide precipitates of a predetermined size. As FIGS. 1-7 illustrate, the solutioning temperature varies based on whether the alloy is a low, medium or high γ' former. Even within those categorizations, the solutioning temperature will vary based on the composition of the specific alloy. Generally, the solutioning temperature increases with increasing γ' content.

Referring now to FIGS. 1-7, these figures indicate generally that increasing weight percentages of Fe added substitutionally for nickel-base superalloys decrease the γ' solvus temperature and decrease the γ' fraction (mole fraction). Increasing Fe generally increases the freezing range. For some of the alloys, increasing the Fe content can increase the formation of detrimental phases such as TCP phases, Sigma or Mu phases. While increasing Fe generally affects these properties as stated, the overall effect of increasing Fe content on each of the alloys varies somewhat.

A first preferred composition of the cast nickel-base superalloys of the present invention are low γ' alloys comprising in weight percent 1-6% Fe, desirably 1-5% Fe, 16-19.1% Co, 20-22.5% Cr, 0.8-2.5% Al, 1.2-4% Ti, 0.75-1.5% Ta, 0.5-1% Nb, 2-3% W, 0.08-0.15% C, 0.004-0.01 B, up to 0.02% Zr, and the balance Ni and incidental impurities. More preferably the alloy includes about 1.5-3.5% Fe and most preferably the alloy includes about 2-3% Fe. The γ' fraction of such low γ' alloys of this preferred composition and including Fe at the 5% level comprises from about 0.15-0.33. The γ' solvus of such low γ' alloys is in the range of 1795-2015° F. (about 979-1102° C.). The freezing range (liquidus-solvus differential) of such low γ' alloys is in the range of 152-180° F. (about 84-100° C.). A Sigma phase may form up to 0.07 mole fraction in some low γ' alloys.

One specific composition of low γ' nickel base alloy is GTD®-222, whose nominal composition without Fe is provided in Table 1. In accordance with the present invention, the nominal composition of GTD®-222 may include from 1-5% Fe, preferably about 3-5% Fe, more preferably 1.5-3.5% Fe and most preferably 2-3% Fe. The effect of increasing Fe on the properties of GTD®-222 is set forth in FIG. 1. Increasing Fe causes a drop in the γ' solvus. Thus, increasing the Fe content in GTD®-222 lowers the maximum temperature that an article made from this alloy may be used. Once γ' is developed, usually by careful heat treatment, resolutioning the γ' should be avoided. With no Fe, the γ' solvus is about 1815° F. (about 990° C.). At 3% Fe, the γ' solvus falls to about 1807° F. (about 986° C.) and continues to fall substantially linearly to 5% Fe, at which the γ' solvus falls to about 1795° F. (about 979° C.). Above about 5% Fe, the γ' solvus continues to decrease in substantially linear fashion, although the slope of the linear decrease appears to become somewhat larger. The mole fraction of γ' also decreases with increasing Fe content at 1550° F., one of the temperatures that components made from this alloy may be used. The γ' mole fraction is about 0.162 when the alloy includes no Fe. The γ' mole fraction decreases linearly with 3% Fe content to about 0.16, decreasing linearly to about 0.15 at about 5% Fe content. The γ' mole fraction continues to decrease with increasing Fe content above 5%. The decreasing γ' mole fraction thus translates to decreasing strength and decreasing creep resistance with increasing Fe content. The liquidus-solidus differential (freezing range) increases with increasing Fe content. The freezing range is about 140° F. when the alloy includes no Fe. The freezing range increases linearly to 3% Fe content where the range is about 152° F., further increasing linearly to about 162° F. at about 5% Fe content. The freezing range continues to increase with increasing Fe content above 5%. The increasing freezing range indicates potential problems with castability with increasing Fe content. Increasing Fe content has no effect on the formation of sigma phases at 1550° F., although at about 8.5% Fe at 1400° F., some sigma phases may develop. Sigma phases are undesirable plates which adversely affects the ductility of the alloy.

Another specific composition of low γ' nickel base alloy is IN 939, whose nominal composition without Fe is provided in Table 1. In accordance with the present invention, the nominal composition of IN 939 may include from 1-5% Fe, preferably about 3-5% Fe, more preferably 1.5-3.5% Fe and most preferably 2-3% Fe. The effect of increasing Fe on the properties of IN 939 is set forth in FIG. 2. Increasing Fe causes a drop in the γ' solvus. Thus, increasing the Fe content in IN 939 lowers the maximum temperature that an article made from this alloy may be used. Once γ' is developed, usually by careful heat treatment, resolutioning the γ' should be avoided. With no Fe, the γ' solvus is about 2030° F. (about 1100° C.). At 3% Fe, the γ' solvus falls to about 2015° F. (about 1101° C.) and continues to fall substantially linearly to 5% Fe, at which the γ' solvus falls to about 2000° F. (about 1093° C.). Above about 5% Fe, the γ' solvus continues to decrease in substantially linear fashion, although the slope of the linear decrease appears to become somewhat larger. The mole fraction of γ' also decreases with increasing Fe content at 1550° F., one of the temperatures that components made from this alloy may be used. The γ' mole fraction is about 0.34 when the alloy includes no Fe. The γ' mole fraction decreases linearly with 3% Fe content to about 0.33, decreasing to about 0.32 at about 5% Fe content. The γ' mole fraction continues to decrease with increasing Fe content above 5%. The decreasing γ' mole fraction thus translates to decreasing strength and decreasing creep resistance with increasing Fe content. The liquidus-solidus differential (freezing range) increases with increasing Fe content. The freezing range is about 165° F. when the alloy includes no Fe. The freezing range increases linearly to 3% Fe content where the range is about 172° F., further increasing linearly to about 180° F. at about 5% Fe content. The freezing range continues to increase with increasing Fe content above 5%. The increasing freezing range indicates potential problems with castability with increasing Fe content. Increasing Fe content affects the formation of sigma phases at 1550° F. in this alloy. Sigma phases are undesirable plates which adversely affect the ductility of the alloy. With no Fe, there is less than 0.01 mole fraction of sigma phase. The mole fraction of sigma phase increases linearly to about 0.04 at 3% Fe. The mole fraction of sigma phase increases in a somewhat non-linear fashion to a mole fraction of about 0.07 at 5% Fe.

Another preferred composition of the cast nickel-based superalloy of the present invention are medium γ' alloys broadly comprising, in weight percent 1-6% Fe, desirably 1-5% Fe, 8.5-9.5% Co, 14-16% Cr, 3-3.5% Al, 3.4-5% Ti, up to 2.8% Ta, up to about 0.85% Nb, 2.6-4% W, 1.5-4% Mo, 0.1-0.18% C, 0.01-0.015 B, up to 0.03% Zr, and the balance Ni and incidental impurities. More preferably the alloy includes about 1.5-3.5% Fe and most preferably the alloy includes about 2-3% Fe. The γ' fraction (in mole fraction) of such medium γ' alloys of this preferred composition at 1700° F. (about 927° C.) and including Fe at the 5% level comprises from about 0.425-0.455. The γ' solvus of such medium γ' alloys is in the range of 2040-2110° F. (about 1116-1154° C.). The freezing range (liquidus-solvus differential) of such medium γ' alloys is in the range of 90-100° F. (about 50-56° C.). Even with 5% Fe, the medium γ' alloys are substantially free of the Mu phase, although up to 0.01 mole fraction of TCP phases may form in some of these alloys at 5% Fe. In other alloys, TCP phases do not form until significantly higher percentages of Fe are added.

One specific composition of medium γ' nickel base alloy is GTD®-111, whose nominal composition without Fe is provided in Table 1. In accordance with the present invention, the nominal composition of GTD®-111 may additionally include from 1-5% Fe, preferably about 3-5% Fe, more preferably 1.5-3.5% Fe and most preferably 2-3% Fe. The effect of increasing Fe on the properties of GTD®-111 is set forth in FIG. 3. Increasing Fe causes a drop in the γ' solvus. Thus, increasing the Fe content in GTD®-111 lowers the maximum temperature that an article made from this alloy may be used. Once γ' is developed, usually by careful heat treatment, resolutioning the γ' should be avoided. With no Fe, the γ' solvus is about 2120° F. (about 1160° C.). At 3% Fe, the γ' solvus falls to about 2100° F. (about 1149° C.) and continues to fall substantially linearly to 5% Fe, at which the γ' solvus falls to about 2090° F. (about 1143° C.). Above about 5% Fe, the γ' solvus continues to decrease in substantially linear fashion. The mole fraction of γ' also decreases with increasing Fe content at 1700° F., one of the temperatures that components made from this alloy may be used. The γ' mole fraction is about 0.50 when the alloy includes no Fe. The γ' mole fraction decreases linearly with 3% Fe content to about 0.48, decreasing to about 0.455% at about 5% Fe content. The slope of linear decrease accelerates between 3% Fe and 5% Fe, as is evident in FIG. 3. The γ' mole fraction continues to decrease with increasing Fe content above 5%. The decreasing γ' mole fraction thus translates to decreasing strength and decreasing creep resistance with increasing Fe content. The liquidus-solidus differential (freezing range) increases with increasing Fe content. The freezing range is about 91° F. when the alloy includes no Fe. The freezing range increases linearly to 3% Fe content where the range is about 97° F., increasing linearly to about 100° F. at about 5% Fe content. The freezing range continues to increase with increasing Fe content above 5%. The increasing freezing range indicates potential problems with castability with increasing Fe content. Increasing Fe content does not appear to affects the formation of TCP phases at 1700° F., and Mu phases do not appear until Fe content is in excess of about 7%.

Another specific composition of medium γ' nickel base alloy is Rene 80, whose nominal composition without Fe is provided in Table 1. In accordance with the present invention, the nominal composition of Rene 80 may additionally include from 1-5% Fe, preferably about 3-5% Fe, more preferably 1.5-3.5% Fe and most preferably 2-3% Fe. The effect of increasing Fe on the properties of Rene 80 is set forth in FIG. 4. Increasing Fe causes a drop in the γ' solvus. Thus, increasing the Fe content in Rene 80 lowers the maximum temperature that an article made from this alloy may be used. Once γ' is developed, usually by careful heat treatment, resolutioning γ' should be avoided. With no Fe, the γ' solvus is about 2105° F. (about 1152° C.). At 3% Fe, the γ' solvus falls to about 2090° F. (about 1143° C.) and continues to fall substantially linearly to 5% Fe, at which the γ' solvus falls to about 2080° F. (about 1138° C.). Above about 5% Fe, the γ' solvus continues to decrease in substantially linear fashion. The mole fraction of γ' also decreases with increasing Fe content at 1700° F., one of the temperatures that components made from this alloy may be used. The γ' mole fraction is about 0.46 when the alloy includes no Fe. The γ' mole fraction decreases linearly with 3% Fe content to about 0.45, decreasing to about 0.44% at about 5% Fe content. The mole fraction of γ' continues to decrease as Fe content increases and drops precipitously, as is evident in FIG. 4. The decreasing γ' mole fraction thus translates to decreasing strength and decreasing creep resistance with increasing Fe content. The liquidus-solidus differential (freezing range) increases with increasing Fe content. The freezing range is about 94° F. when the alloy includes no Fe. The freezing range increases linearly to 3% Fe content where the range is about 96° F., increasing linearly to about 100° F. at about 5% Fe content. The freezing range continues to increase with increasing Fe content above 5%. The increasing freezing range may indicate potential problems with castability with increasing Fe content, although the freezing range is substantially flat in the iron content of interest. Increasing Fe content increases the formation of TCP phases at 1700° F. At 3% Fe, TCP phase mole fraction is less than 0.01 and increases to about 0.01 at 5% Fe. TCP phases, like the previously discussed sigma phases, are undesirable phases in nickel-base superalloys, as they adversely affect the mechanical properties of the alloy.

Still another specific composition of medium γ' nickel base alloy is IN 738, whose nominal composition is provided in Table 1. It should be noted that the prior art nominal composition of IN 738 already permits up to 0.5% Fe. The present invention contemplates that IN 738 nominally may include additional Fe, from 1-5% Fe, preferably about 3-5% Fe, more preferably 1.5-3.5% Fe and most preferably 2-3% Fe. The effect of increasing Fe on the properties of IN 738 is set forth in FIG. 5. Increasing Fe causes a drop in the γ' solvus. Thus, increasing the Fe content in IN 738 lowers the maximum temperature that an article made from this alloy may be used. Once γ' is developed, usually by careful heat treatment, resolutioning γ' should be avoided. With no Fe, the γ' solvus is about 2072° F. (about 1133° C.). At 3% Fe, the γ' solvus falls to about 2055° F. (about 1124° C.) and continues to fall substantially linearly to 5% Fe, at which the γ' solvus falls to about 2040° F. (about 1116° C.). Above about 5% Fe, the γ' solvus continues to decrease in substantially linear fashion. The mole fraction of γ' also decreases with increasing Fe content at 1700° F., one of the temperatures that components made from this alloy may be used. The γ' mole fraction is just below 0.45 when the alloy includes no Fe. The γ' mole fraction decreases linearly with 3% Fe content to about 0.44, decreasing to about 0.425% at about 5% Fe content. The mole fraction of γ' continues to decrease as Fe content increases and drops precipitously above 5%, as is evident in FIG. 5. The decreasing γ' mole fraction thus translates to decreasing strength and decreasing creep resistance with increasing Fe content. The liquidus-solidus differential (freezing range) increases with increasing Fe content. The freezing range is about 89° F. when the alloy includes no Fe. The freezing range slightly increases linearly to 3% Fe content where the range is about 91° F., increasing linearly to about 97° F. at about 5% Fe content. The freezing range continues to increase with increasing Fe content above 5%. The increasing freezing range may indicate potential problems with castability with increasing Fe content, although the freezing range is substantially flat in the iron content of interest. Increasing Fe content in this alloy does not appear to increase the formation of deleterious TCP phases at 1700° F. until Fe content is 10% or greater.

Another preferred composition of the cast nickel-based superalloy of the present invention are high γ' alloys broadly comprising, in weight percent 1-6% Fe, desirably 1-5% Fe, 7.0-8.0% Co, 6.5-10.5% Cr, 3.5-6.5% Al, up to about 4% Ti, 4.5-6.8% Ta, up to 0.6% Nb, 4.6-6.4% W, up to 3.2% Re, 1.3-1.7% Mo, 0.04-0.06% C, 0.13-0.17% Hf, 0.003-0.005% B, and the balance Ni and incidental impurities. More preferably the alloy includes about 1.5-3.5% Fe and most preferably the alloy includes about 2-3% Fe. The γ' fraction (in mole fraction) of such high gamma prime alloys of this preferred composition at 1800° F. (about 982° C.) and including Fe at the 5% level is greater than 0.5 mole fraction, preferably comprising from about 0.52-0.59 mole fraction. The γ' solvus of such high γ' alloys is in the range of 2135-2285° F. (about 1168-1252° C.). The freezing range (liquidus-solvus differential) of such high γ' alloys is in the range of 105-115° F. (about 58-64° C.). TCP phases may present more of a problem with high γ' superalloys than with low and medium γ' superalloys with increasing Fe content, as these alloy appear more susceptible to formation of TCP phases. At 1800° F., these alloys desirably form less than 0.03 mole fraction, and preferably less than 0.025 mole fraction TCP phases at 5% iron content, with TCP phases increasing with increasing Fe content.

Figure 6:
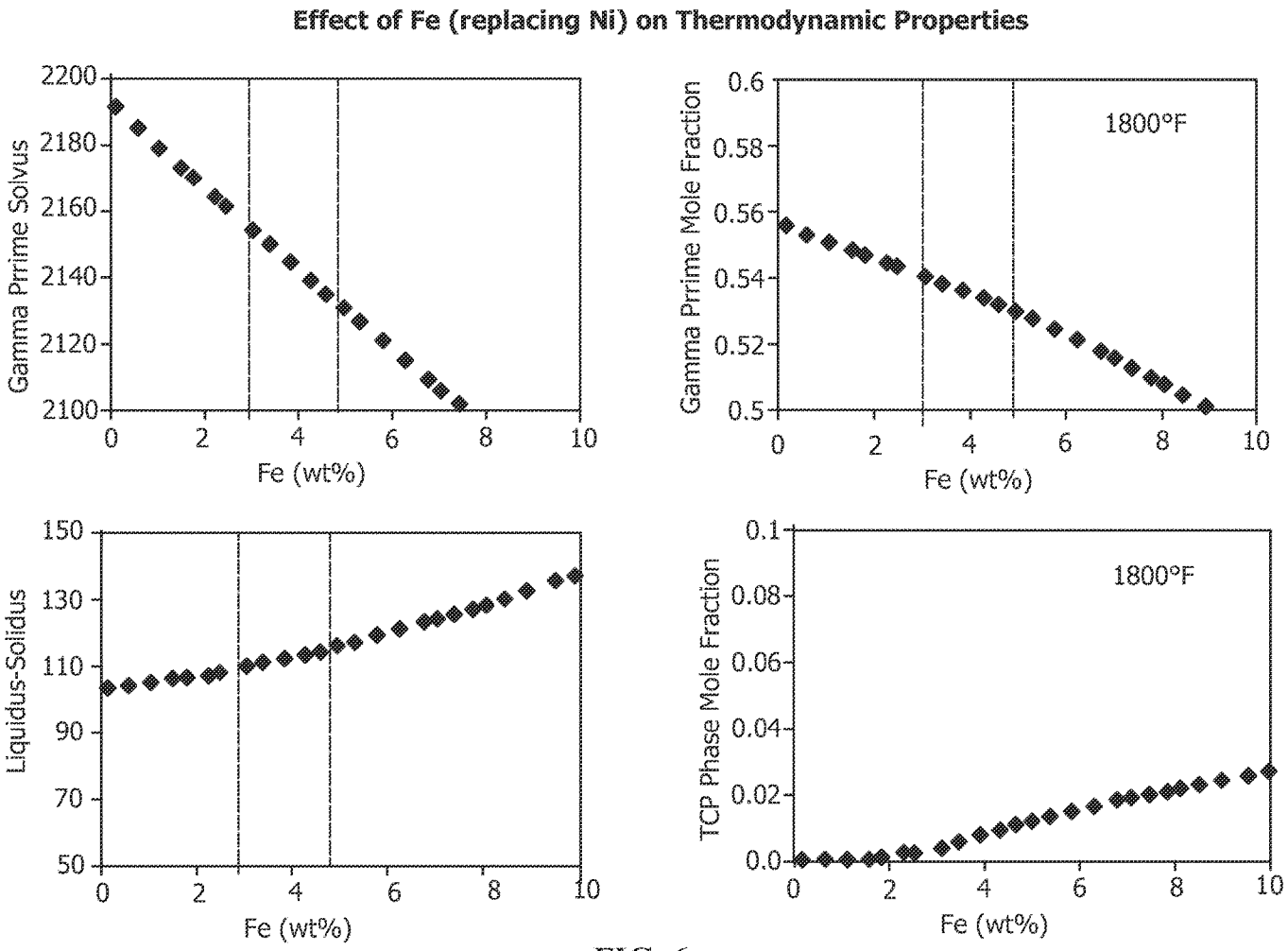
FIG. 6 depicts the effect of increased Fe in nickel-base superalloy RENE N4 on the following properties: gamma prime solvus, gamma prime mole fraction at 1800° F., liquidus-solidus differential (or freezing range) and TCP phase formation at 1800° F.

One specific composition of high γ' nickel base alloy is Rene N4, whose nominal composition without Fe is provided in Table 1. In accordance with the present invention, the nominal composition of Rene N4 may additionally include from 1-5% Fe, preferably about 3-5% Fe, more preferably 1.5-3.5% Fe and most preferably 2-3% Fe. The effect of increasing Fe on the properties of Rene N4 is set forth in FIG. 6. Increasing Fe causes a drop in the γ' solvus. Thus, increasing the Fe content in Rene N4 lowers the maximum temperature that an article made from this alloy may be used. Once γ' is developed, usually by careful heat treatment, resolutioning the γ' should be avoided. With no Fe, the γ' solvus of Rene N4 is about 2195° F. (about 1202° C.). At 3% Fe, the γ' solvus falls to about 2100° F. (about 1149° C.) and continues to fall substantially linearly to 5% Fe, at which the γ' solvus falls to about 2175° F. (about 1191° C.). Above about 5% Fe, the γ' solvus continues to decrease in substantially linear fashion. The mole fraction of γ' also decreases with increasing Fe content at 1800° F., one of the temperatures that components made from this alloy may be used. The γ' mole fraction is about 0.555 when the alloy includes no Fe. The γ' mole fraction decreases linearly to 3% Fe content to about 0.54, decreasing to about 0.51% at about 5% Fe content. The γ' mole fraction continues to decrease linearly with increasing Fe content, as shown in FIG. 6. The decreasing γ' mole fraction thus translates to decreasing strength and decreasing creep resistance with increasing Fe content. The liquidus-solidus differential (freezing range) increases with increasing Fe content. The freezing range is about 98° F. when the alloy includes no Fe. The freezing range increases linearly with increasing Fe content. At 3% Fe content, the range is about 110° F., increasing linearly to about 117° F. at about 5% Fe content. The freezing range continues to increase with increasing Fe content above 5%. The increasing freezing range indicates potential problems with castability with increasing Fe content. Increasing Fe content affects the formation of TCP phases at 1800° F., showing little or no formation of TCP phases below 2% Fe, then TCP phases beginning to form at about 2% Fe content and increasing to about 0.015 at 5% Fe and continuing to increase with further increases in Fe content.

Figure 7:
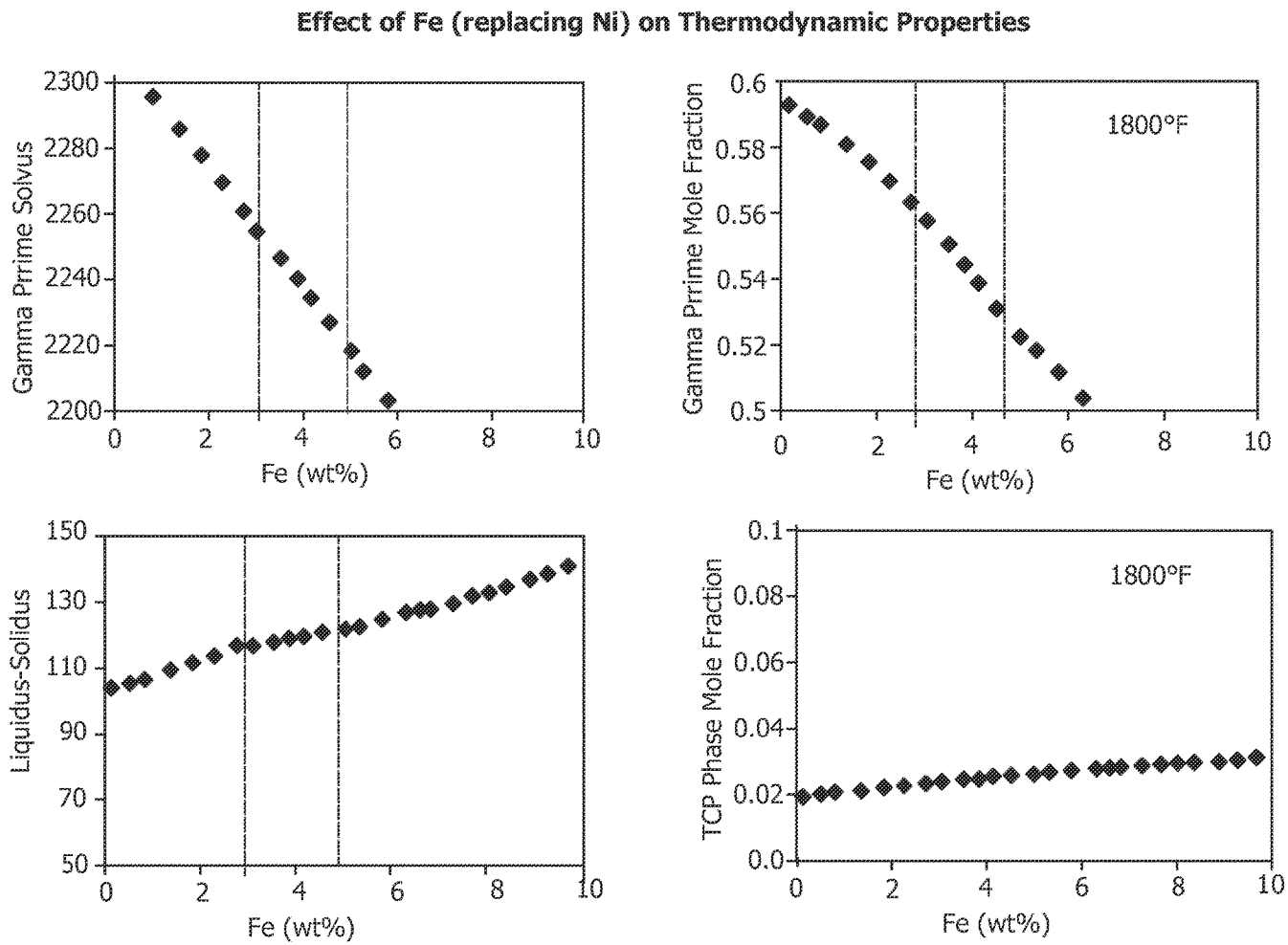
FIG. 7 depicts the effect of increased Fe in nickel-base superalloy RENE N5 on the following properties: gamma prime solvus, gamma prime mole fraction at 1800° F., liquidus-solidus differential (or freezing range) and TCP phase formation at 1800° F.

Another specific composition of high γ' nickel base alloy is Rene N5, whose nominal composition without Fe is provided in Table 1. In accordance with the present invention, the nominal composition of Rene N5 may additionally include from 1-5% Fe, preferably about 3-5% Fe, more preferably 1.5-3.5% Fe and most preferably 2-3% Fe. The effect of increasing Fe on the properties of Rene N5 is set forth in FIG. 7. Increasing Fe causes a drop in the γ' solvus. Thus, increasing the Fe content in Rene N5 lowers the maximum temperature that an article made from this alloy may be used. Once γ' is developed, usually by careful heat treatment, resolutioning the γ' should be avoided. With no Fe, the γ' solvus of Rene N5 is above 2300° F. (about 1260° C.). At 3% Fe, the γ' solvus falls to about 2255° F. (about 1235° C.) and continues to fall substantially linearly to 5% Fe, at which the γ' solvus falls to about 2220° F. (about 1216° C.). Above about 5% Fe, the γ' solvus continues to decrease in substantially linear fashion. The mole fraction of γ' also decreases with increasing Fe content at 1800° F., one of the temperatures that components made from this alloy may be used. The γ' mole fraction is about 0.59 when the alloy includes no Fe. The γ' mole fraction decreases linearly to 3% Fe content to about 0.56, decreasing to about 0.53 at about 5% Fe content. The gamma prime mole fraction continues to decrease linearly with increasing Fe content, as shown in FIG. 7. The decreasing γ' mole fraction thus translates to decreasing strength and decreasing creep resistance with increasing Fe content. The liquidus-solidus differential (freezing range) increases with increasing Fe content. The freezing range is about 102° F. when the alloy includes no Fe. The freezing range increases linearly with increasing Fe content. At 3% Fe content, the range is about 115° F., increasing linearly to about 121° F. at about 5% Fe content. The freezing range continues to increase with increasing Fe content above 5%. The increasing freezing range indicates potential problems with castability with increasing Fe content, and although the freezing range increases, the change in the freezing range is not large, being about 20° F. in an alloy having no Fe to one that includes 5% Fe. Increasing Fe content affects the formation of TCP phases at 1800° F., showing a slight increase in formation of TCP phases with increasing Fe content. Rene N5 already exhibits a susceptibility to form TCP phases. With no Fe content, about 0.02 mole fraction of TCP phases form in Rene N5. While increasing Fe content increases the mole fraction of TCP phases formed, the increase is linear and the slope is shallow. At 3% Fe, about 0.025 mole fraction TCP phases are formed in Rene 5 at 1800° F. At 5% Fe, about 0.028 mole fraction TCP phases are formed in Rene 5 at 1800° F.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A cast nickel-base superalloy comprising, in weight percent:

about 5% Fe,
16-19.1% Co,
20-22.5% Cr,
0.8-2.5% Al,
1.2-4% Ti,
0.75-1.5% Ta,
0.5-1% Nb,
2-3% W,
0.08-0.15% C,
0.004-0.01 B,
up to 0.02% Zr, and
the balance Ni and incidental impurities, wherein the superalloy is a low γ' alloy and the superalloy is characterized by a γ' mole fraction that is no more than 15% less than a comparative γ' mole fraction of a comparable superalloy that does not include 1-6% Fe.

2. The superalloy of claim 1 wherein the superalloy has a nominal composition comprising, in weight percent:

about 5% Fe,
19.1% Co,
22.5% Cr,
1.2% Al,
2.3% Ti,
0.94% Ta,
0.8% Nb,
2% W,
0.08% C,
0.004% B,
0.02% Zr, and
the balance Ni and incidental impurities.

3. The superalloy of claim 1 wherein the superalloy has a nominal composition comprising, in weight percent:

about 5% Fe,
19% Co,
22.5% Cr,
1.9% Al,
3.7% Ti,
1.4% Ta,
1% Nb,
2% W,
0.15% C,
0.01% B,
0.1% Zr, and
the balance Ni and incidental impurities.

4. The superalloy of claim 1 wherein the superalloy is characterized by a γ' solvus temperature that is no more than 5% less than a comparative γ' solvus temperature of the comparable superalloy that does not include 1-6% Fe.

5. The superalloy of claim 1 wherein the cast nickel-base superalloy includes, in weight percent, 5% iron.

* * * * *